US011412841B2

(12) United States Patent
Leng

(10) Patent No.: US 11,412,841 B2
(45) Date of Patent: Aug. 16, 2022

(54) FOLDING TABLE

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 18 days.

(21) Appl. No.: 17/168,713

(22) Filed: Feb. 5, 2021

(65) Prior Publication Data

US 2021/0267361 A1 Sep. 2, 2021

(30) Foreign Application Priority Data

Feb. 27, 2020 (CN) ..... 202020221384.0
Sep. 29, 2020 (CN) ..... 202022199246.X

(51) Int. Cl.
*A47B 3/08* (2006.01)
*A47B 9/14* (2006.01)
*A47B 5/06* (2006.01)

(52) U.S. Cl.
CPC ..... *A47B 3/08* (2013.01); *A47B 5/06* (2013.01); *A47B 9/14* (2013.01); *A47B 2009/145* (2013.01); *A47B 2200/0025* (2013.01); *A47B 2200/0036* (2013.01); *A47B 2200/0042* (2013.01)

(58) Field of Classification Search
CPC .... A47B 3/08; A47B 5/06; A47B 9/14; A47B 2009/145; A47B 2200/0025; A47B 2200/0036; A47B 2200/0042
USPC ..... 108/134, 49, 2, 150, 6
See application file for complete search history.

(56) References Cited

U.S. PATENT DOCUMENTS 2,703,265 A * 3/1955 Wolfe ..... A47B 23/02 248/214
4,561,622 A * 12/1985 Heinzel ..... A47B 3/0815 108/131
4,879,954 A * 11/1989 Sawamura ..... A47B 3/00 108/6
4,986,195 A * 1/1991 Diffrient ..... A47B 3/08 108/1
5,323,713 A * 6/1994 Luyk ..... A47B 3/0815 108/131

(Continued)

FOREIGN PATENT DOCUMENTS

CN 106724015 A * 5/2017
CN 109760571 A * 5/2019

*Primary Examiner* — Daniel J Troy
*Assistant Examiner* — Timothy M Ayres
(74) *Attorney, Agent, or Firm* — Cooper Legal Group, LLC

(57) ABSTRACT

The present disclosure discloses a folding table comprises a table board, a support leg, and a bracket connected between the table board and the support leg. A top portion of the bracket is disposed with an upper crossbar. The upper crossbar is positioned on a rear portion of a bottom surface of the table board, and the table board is configured to rotate about the upper crossbar. A bottom portion of the table board is disposed with one or more pawls, and the upper crossbar is disposed with one or more lock plates. Edges of the one or more lock plates comprise at least one ratchet wheel groove. When the one or more pawls are disposed in the at least one ratchet wheel groove, the table board is configured to rotate upward.

15 Claims, 15 Drawing Sheets

(56) References Cited

U.S. PATENT DOCUMENTS

| | | | | | |
|---|---|---|---|---|---|
| 5,673,633 | A * | 10/1997 | Pfister | A47B 3/0815 | 108/131 |
| 7,182,302 | B2 * | 2/2007 | Noniewicz | B25H 1/04 | 108/116 |
| D626,238 | S * | 10/2010 | Zinnanti | D24/185 | |
| 7,836,833 | B2 * | 11/2010 | Kumazawa | A47B 3/0815 | 108/115 |
| 9,149,111 | B1 * | 10/2015 | Lin | A47B 19/06 | |
| 9,585,467 | B2 * | 3/2017 | Leng | A47B 21/02 | |
| 2003/0167980 | A1 * | 9/2003 | Suzuki | A47B 3/0815 | 108/129 |
| 2009/0241805 | A1 * | 10/2009 | Hernandez | A47B 3/0815 | 108/6 |
| 2013/0284076 | A1 * | 10/2013 | Okuda | A47B 3/0818 | 108/115 |

* cited by examiner

FOLDING TABLE

RELATED APPLICATIONS

This application claims priority to Chinese patent application number 202020221384.0, filed Feb. 27, 2020, and Chinese patent application number 202022199246.X, filed Sep. 29, 2020. Chinese patent application number 202020221384.0 and Chinese patent application number 202022199246.X are incorporated herein by reference.

FIELD OF THE DISCLOSURE

The present disclosure relates to a folding table.

BACKGROUND OF THE DISCLOSURE

Existing folding tables mainly comprise a table board and a pair of X-shaped cross legs. The table board is hinged on the X-shaped cross legs. The X-shaped cross legs are folded while the table board is turned over. Although the structure of folding tables with X-shaped cross legs is very simple, the table board is simply and rotatably connected to the X-shaped cross legs without any positioning, which enables the folding table to be unfolded and folded at will, and the structure is very weak.

In order to enhance the stability of the folding table, people have added a support frame between the table board and table legs. The table board and the table legs are respectively and rotatably connected to the support frame. The table board and the support frame, as well as the table legs and the support frame, are connected by support poles. This structure relies on the support poles, which are usually diagonally situated, to maintain a structural stability of the table when the table is in an unfolded state, which greatly improves a rigidity of the folding table. However, there are multiple, diagonally situated support poles arranged under the table board. The diagonally situated support poles limit a utilization rate of space under the table board. The space able to receive feet under the folding table is reduced, the comfort of people sitting at the folding table is not very good, and usage of the folding table is inconvenient. In addition, in order to further improve the stability of the folding table when the folding table is unfolded, some folding tables also have a locking mechanism between the table board and the support frame. For example, an elastic buckle on the support frame snaps into a locking hole of the table board. When the locking mechanism is unlocked, the elastic buckle needs to be forced opened. Fingers of a user can be easily pinched, and the operation is very inconvenient.

BRIEF SUMMARY OF THE DISCLOSURE

The present disclosure provides a folding table. The folding structure of the folding table is firm and simple, and the folding structure is convenient to use.

In order to solve the technical problems, a technical solution of the present disclosure is as follows.

A folding table comprises a table board, a support leg, and a bracket connected between the table board and the support leg. A top portion of the bracket is disposed with an upper crossbar, the upper crossbar is positioned on a rear portion of a bottom surface of the table board, the table board is configured to rotate about the upper crossbar, a bottom portion of the table board is disposed with one or more pawls, the upper crossbar is disposed with one or more lock plates, edges of the one or more lock plates comprise at least one ratchet wheel groove. When the one or more pawls are disposed in the at least one ratchet wheel groove, the table board is configured to rotate upward. When the folding table is in a folded state, the one or more pawls are separated from the at least one ratchet wheel groove, and the table board rotates downward to be vertically disposed. When the folding table is in an unfolded state, the table board rotates upward. When the one or more pawls are disposed in the at least one ratchet wheel groove, the table board is locked to prevent the table board from rotating downward. When the table board needs to be folded, the table board firstly rotates upward to enable the one or more pawls to be separated from the at least one ratchet wheel groove, and the table board then rotates downward to be folded.

Compared with the existing techniques, the technical solution has the following advantages.

The top of the bracket is disposed with an upper crossbar to rotatably connect with the table board, so that the table board can be rotated around the upper crossbar to realize folding and unfolding. Moreover, the bottom of the table board is disposed with pawl, and the upper crossbar is equipped with ratchet wheel grooves. The pawl and the ratchet wheel groove define a ratchet and pawl mechanism to limit the position of the table board. The table board cannot be turned down when in use, and the table board can bear weight well. The structure is firm, and the structure under the table board is simple. When the table board needs to be folded, the table board can be turned upward to separate the pawl from the ratchet wheel groove to realize unlocking. After unlocking, the table board can be turned down to a folded state, which is very convenient to operate

BRIEF DESCRIPTION OF THE DRAWINGS

The present disclosure will be further described below in combination with the accompanying drawings and embodiments.

DETAILED DESCRIPTION OF THE EMBODIMENTS

Embodiment 1

Figure 1:
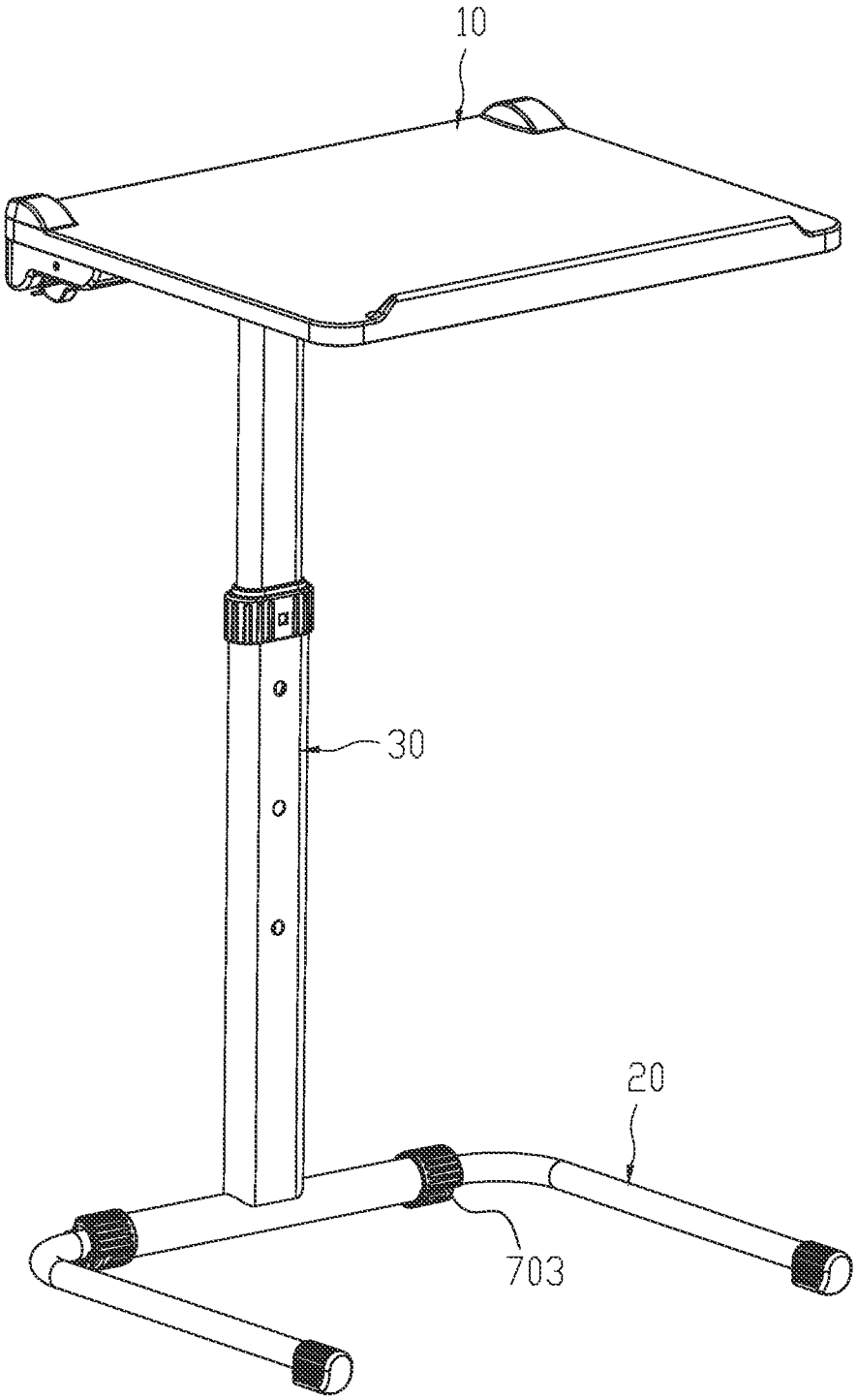
FIG. 1 illustrates a perspective view of a folding table of Embodiment 1.
Figure 2:
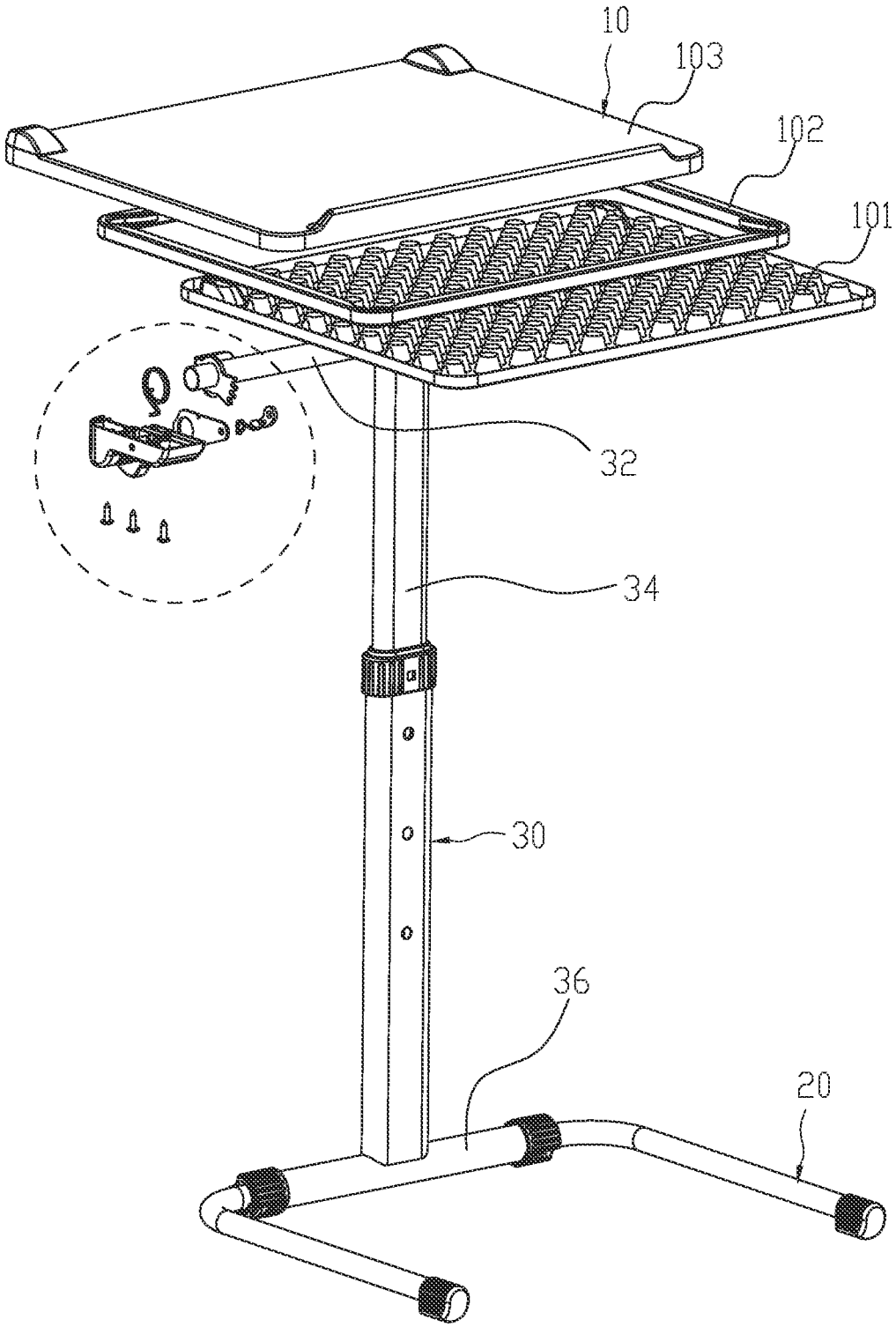
FIG. 2 illustrates an exploded perspective view of a portion of the folding table in FIG. 1.
Figure 3:
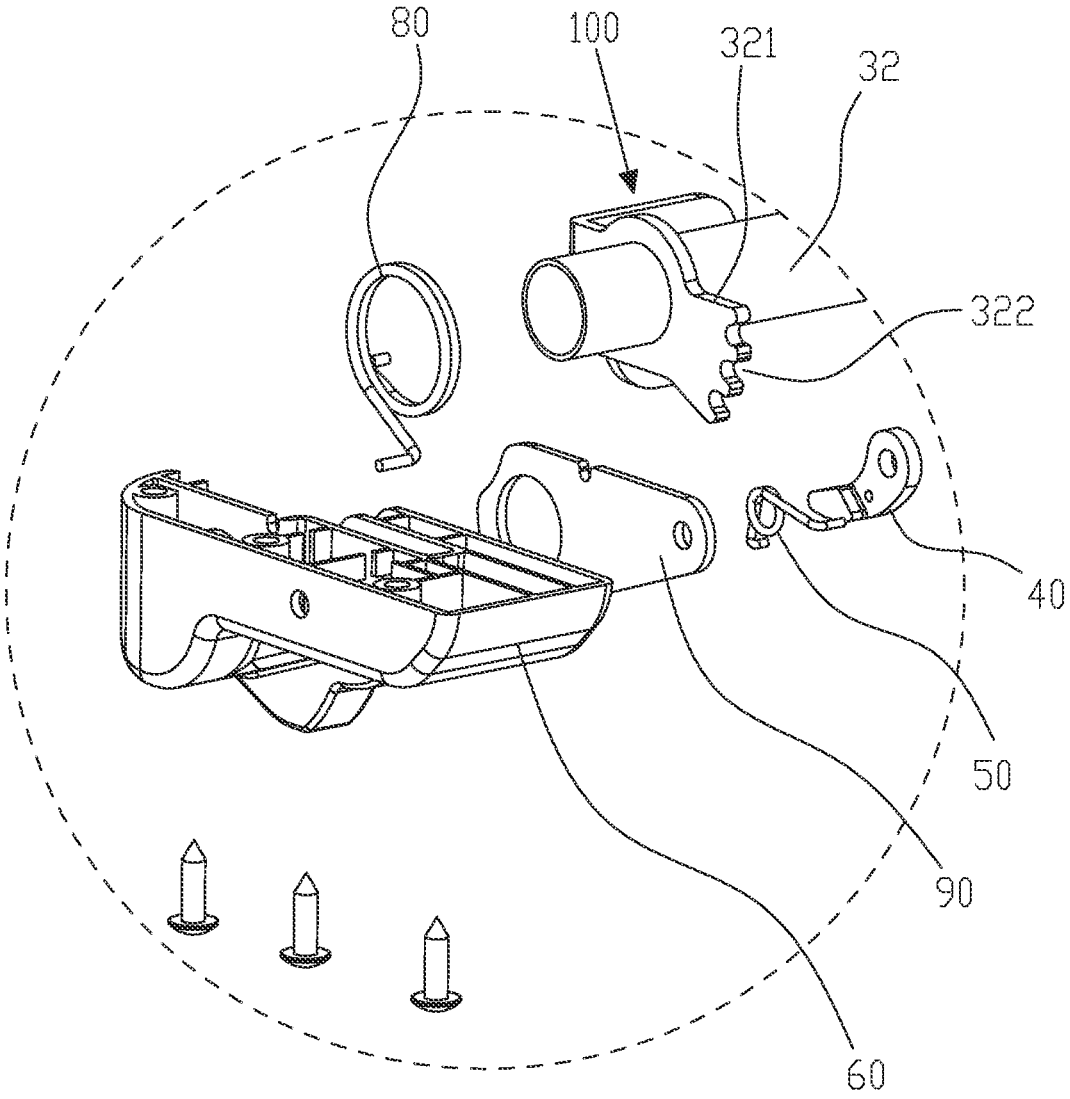
FIG. 3 illustrates an enlarged view of a circle in FIG. 2.

Referring to FIGS. 1-9, a folding table comprises a table board 10, a support leg 20, and a bracket 30 connected between the table board 10 and the support leg 20. The table board 10 is configured to be folded or unfolded for use using a folding structure.

A top portion of the bracket 30 is disposed with an upper crossbar 32, and the upper crossbar 32 is positioned on a rear portion of a bottom surface of the table board 10. The table board 10 is configured to rotate (i.e., rotates 90 degrees) about the upper crossbar 32. A bottom portion of the table board 10 is disposed with one or more pawls 40. The upper crossbar 32 is disposed with one or more lock plates 321. Edges of the one or more lock plates 321 comprise at least one ratchet wheel groove 322, and the one or more pawls 40 and the at least one ratchet wheel groove 322 define one or more ratchet and pawl mechanisms. That is, when the one or more pawls 40 are snapped to the ratchet wheel groove 322, the table board 10 is restricted to rotate in a single direction (i.e., rotate 90 degrees in a single direction). In this embodiment, the table board 10 is configured to rotate upward when the one or more pawls 40 are disposed in the at least one ratchet wheel groove 322.

Figure 4:
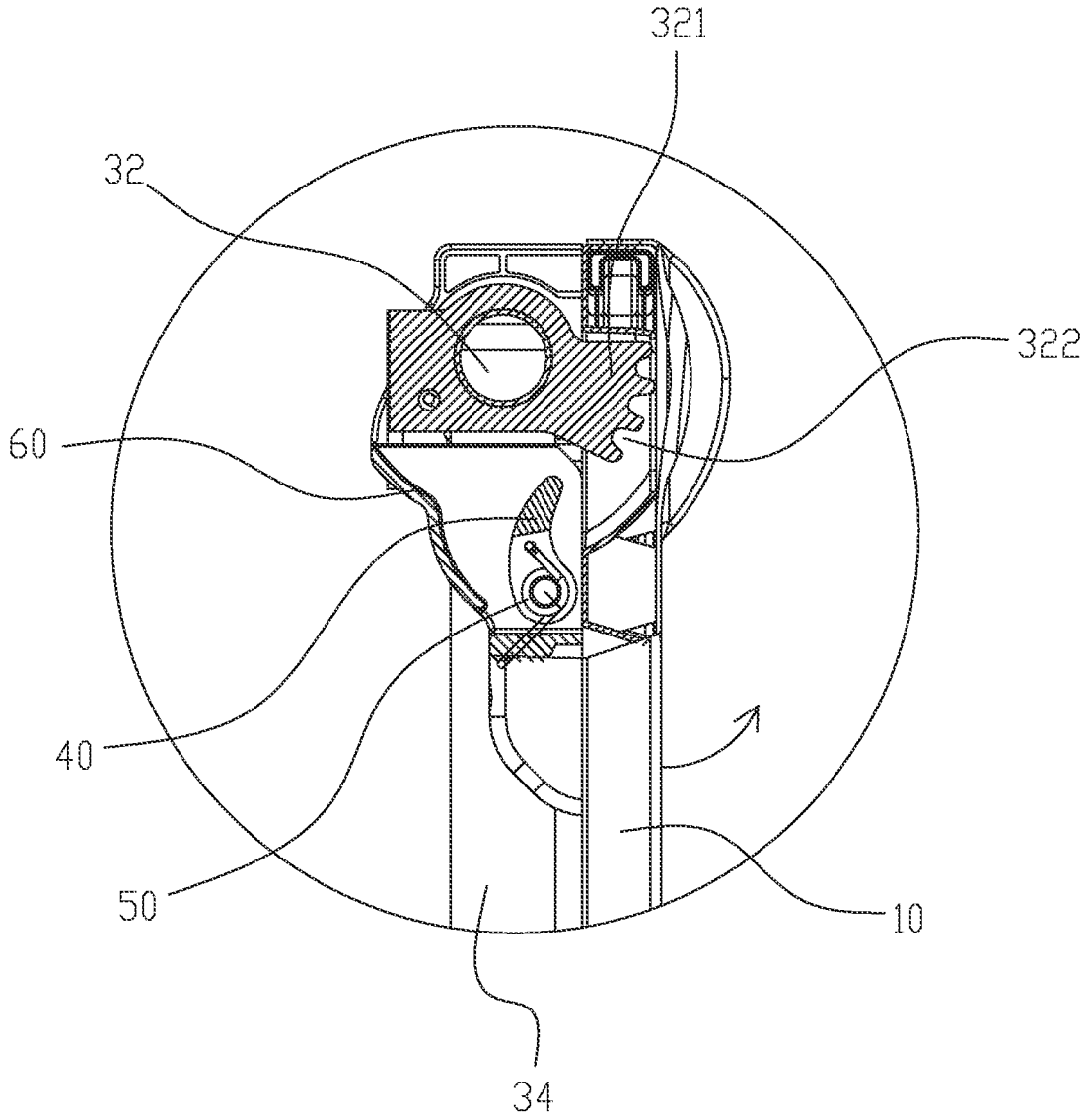
FIG. 4 illustrates a view of a pawl and ratchet wheel grooves of Embodiment 1 when a table board of the folding table is folded and the pawl is separated from the ratchet wheel grooves.
Figure 5:
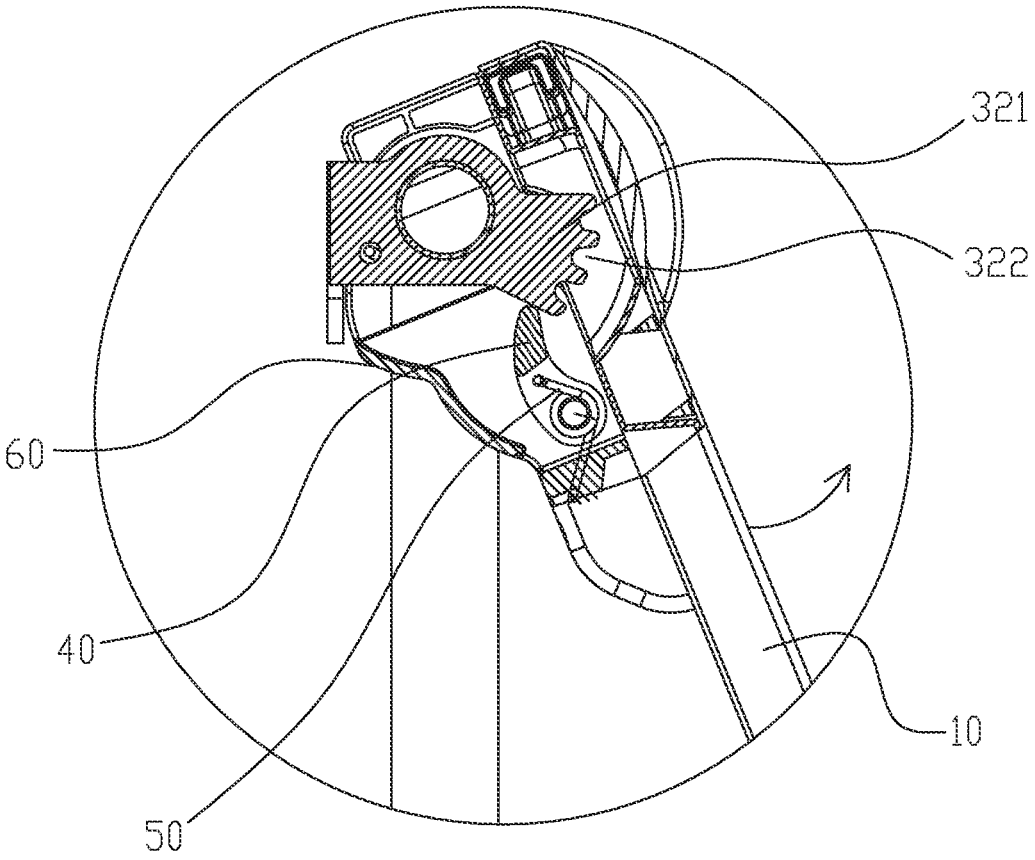
FIG. 5 illustrates a view of the pawl and the ratchet wheel grooves of Embodiment 1 when the table board rotates upward and the pawl is still separated from the ratchet wheel grooves.
Figure 6:
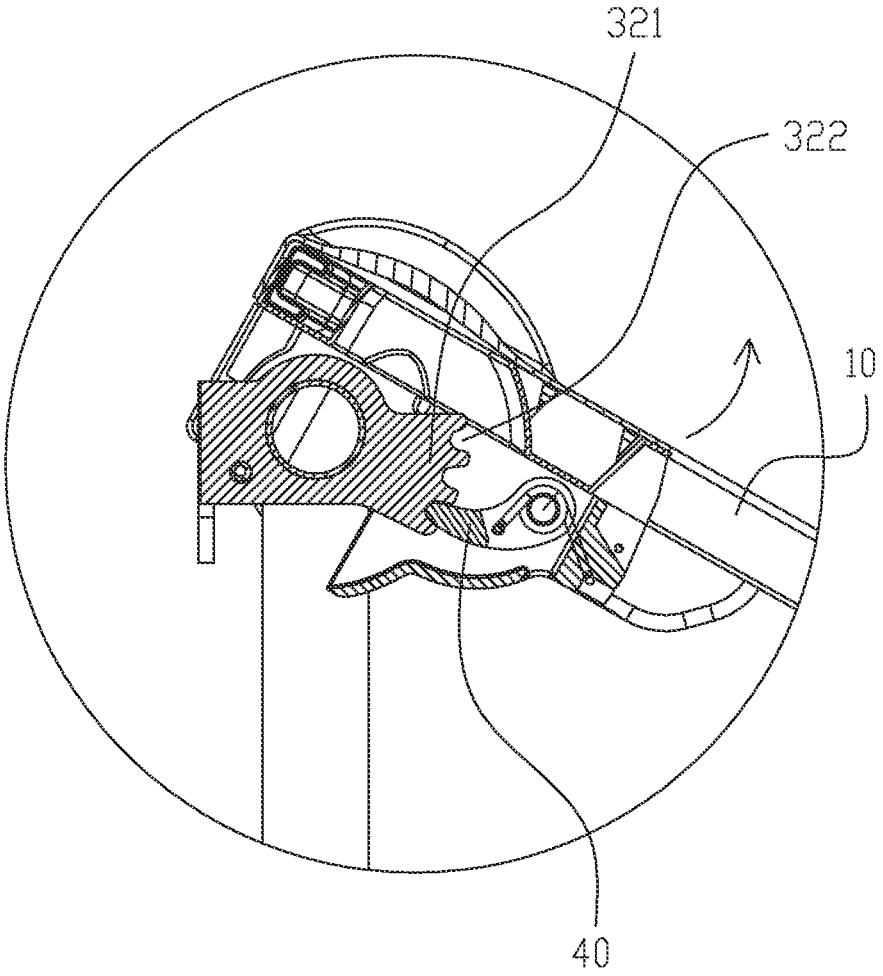
FIG. 6 illustrates a view of the pawl and the ratchet wheel grooves of Embodiment 1 when the table board rotates upward and the pawl is disposed in a lowermost ratchet wheel groove of the ratchet wheel grooves.
Figure 7:
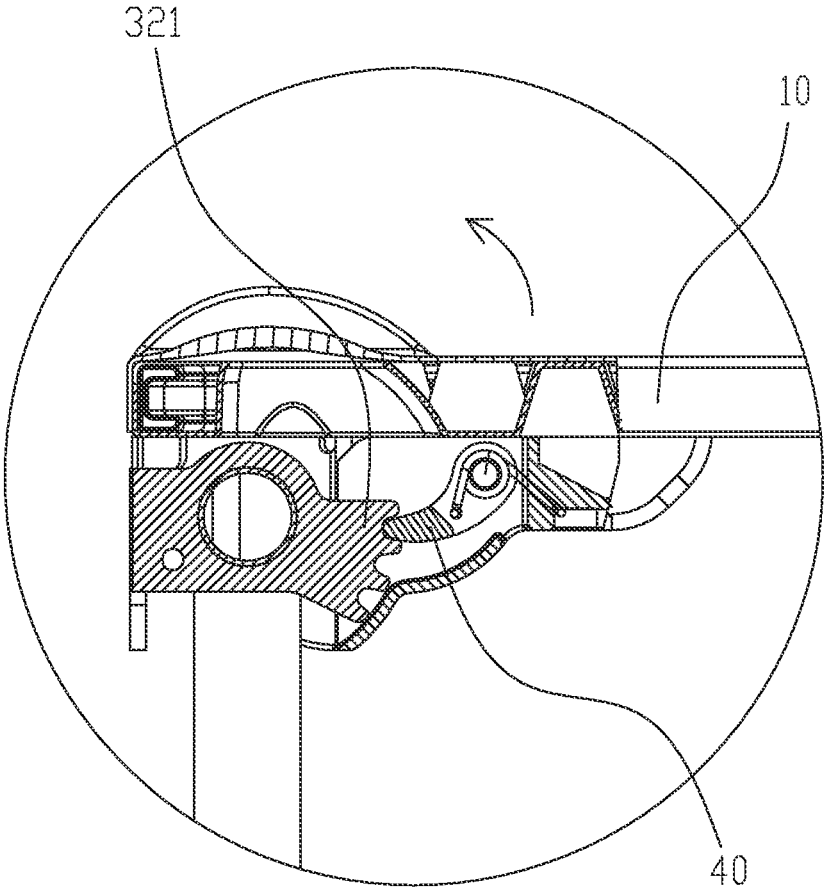
FIG. 7 illustrates a view of the pawl and the ratchet wheel grooves of Embodiment 1 when the table board rotates upward and the pawl is disposed in an uppermost ratchet wheel groove of the ratchet wheel grooves.
Figure 8:
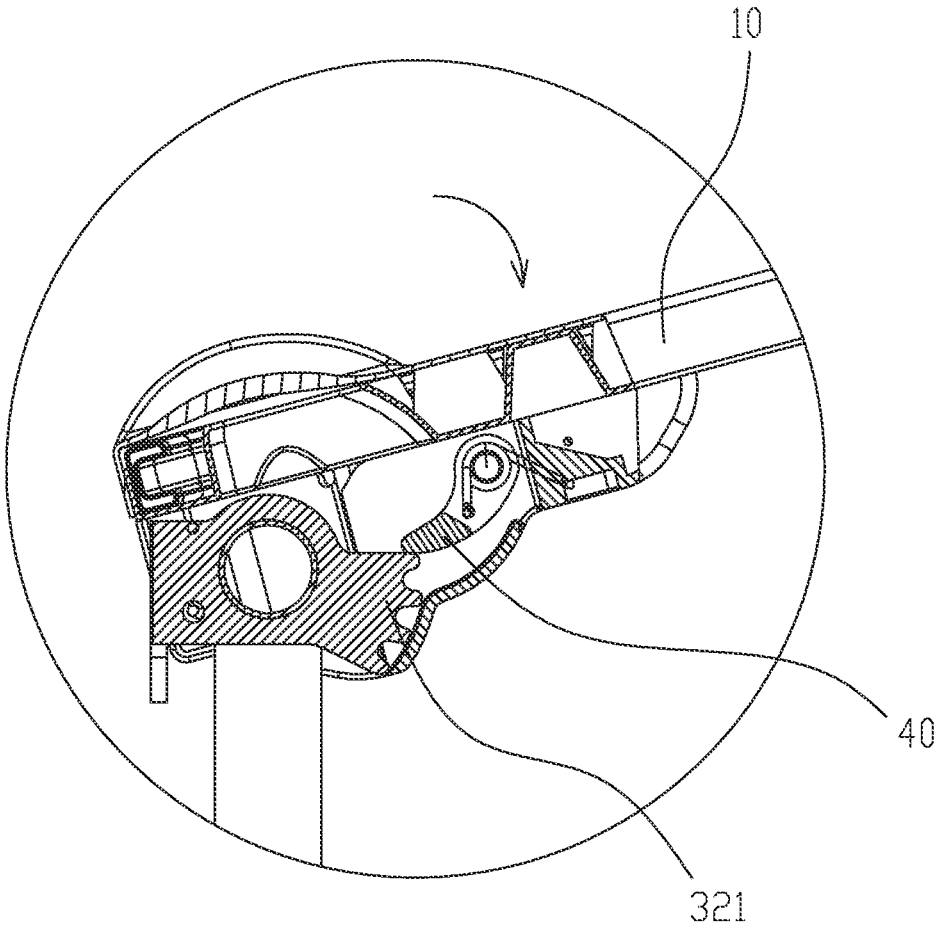
FIG. 8 illustrates a view of the pawl and the ratchet wheel grooves of Embodiment 1 when the table board rotates upward and the pawl slides over the uppermost ratchet wheel groove.

In a folded state (as shown in FIG. 4), the one or more pawls 40 are separated from the at least one ratchet wheel groove 322, and the table board 10 rotates downward to be vertically disposed. In an unfolded state (i.e., a use state) (as shown in FIGS. 5 to 7), the table board 10 rotates upward, when the one or more pawls 40 are disposed in the at least one ratchet wheel groove 322, and the table board 10 is locked to prevent the table board 10 from rotating downward. When the table board 10 needs to be folded, the table board 10 firstly rotates upward to enable the one or more pawls 40 to be separated from the at least one ratchet wheel groove 322 (as shown in FIG. 8). That is, the table board 10 is firstly unlocked, and then the table board 10 rotates downward again to be folded and returns to the state shown in FIG. 4.

The one or more pawls 40 of the table board 10 and the at least one ratchet wheel groove 322 of the bracket 30 define the one or more ratchet and pawl mechanisms to position the table board 10 during use in the unfolded state, and the table board 10 only needs to rotate upward to release the positioning to fold the table board 10. The operation is very convenient. In some embodiments, the one or more lock plates 321 are fan-shaped plate structures, and the one or more pawls 40 are disposed in the at least one ratchet wheel groove 322 to limit a rotation direction of the table board 10. Mating relationships between the one or more pawls 40 and the at least one ratchet wheel groove 322 are conventional and will not be described further herein.

In some embodiments, the folding table further comprises one or more snapping torsion springs 50, and the one or more snapping torsion springs 50 apply upward elastic forces to the one or more pawls 40 to enable the one or more pawls 40 to be fastened to the at least one ratchet wheel groove 322. In this way, when the one or more pawls 40 rotate with the table board 10 to align with the at least one ratchet wheel groove 322, the one or more pawls 40 are completely automatically fastened to the at least one ratchet wheel groove 322 without manual intervention. The operation is therefore more convenient.

In some embodiments, one or more mounting bases 60 are disposed on a lower side (i.e., the bottom surface) of the table board 10, and the one or more mounting bases 60 are locked to the lower side of the table board 10 by screws. The one or more pawls 40 are disposed on the one or more mounting bases 60, first ends of the one or more snapping torsion springs 50 are tensioned to abut the one or more mounting bases 60, and second ends of the one or more snapping torsion springs 50 are secured to the one or more pawls 40. The one or more pawls 40 are disposed on the one or more mounting bases 60, so that an internal structure of the table board 10 will not be occupied. The internal structure of the table board 10 does not need to be changed, and the table board 10 can be made to be thin.

Figure 9:
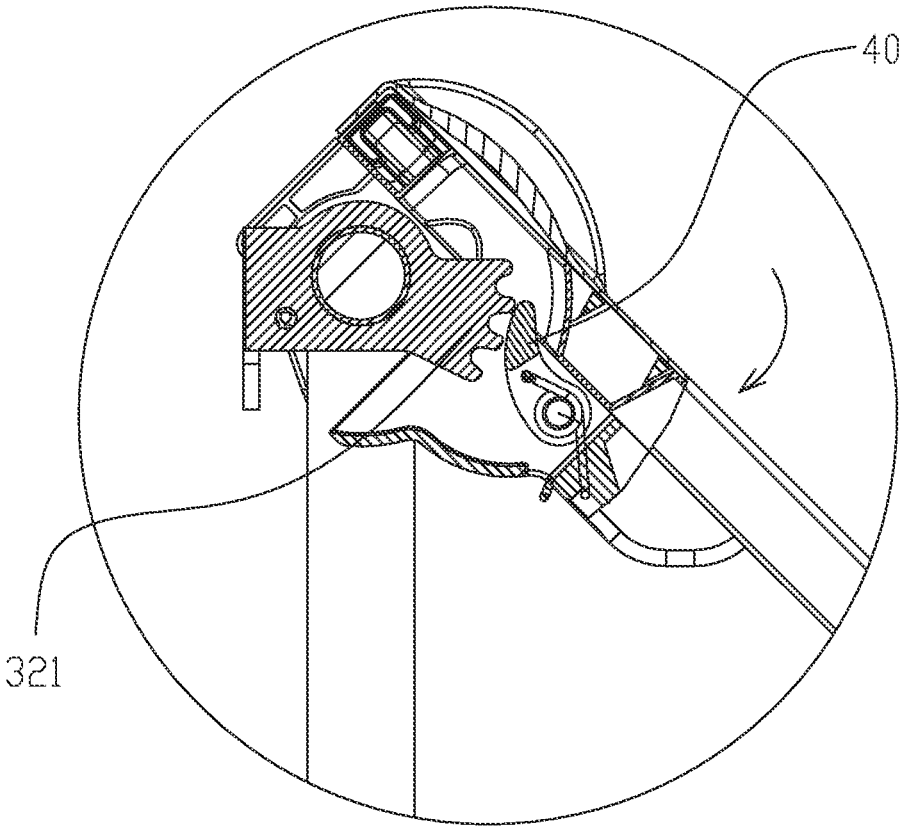
FIG. 9 illustrates a view of the pawl and the ratchet wheel grooves of Embodiment 1 when the table board rotates downward.
Figure 10:
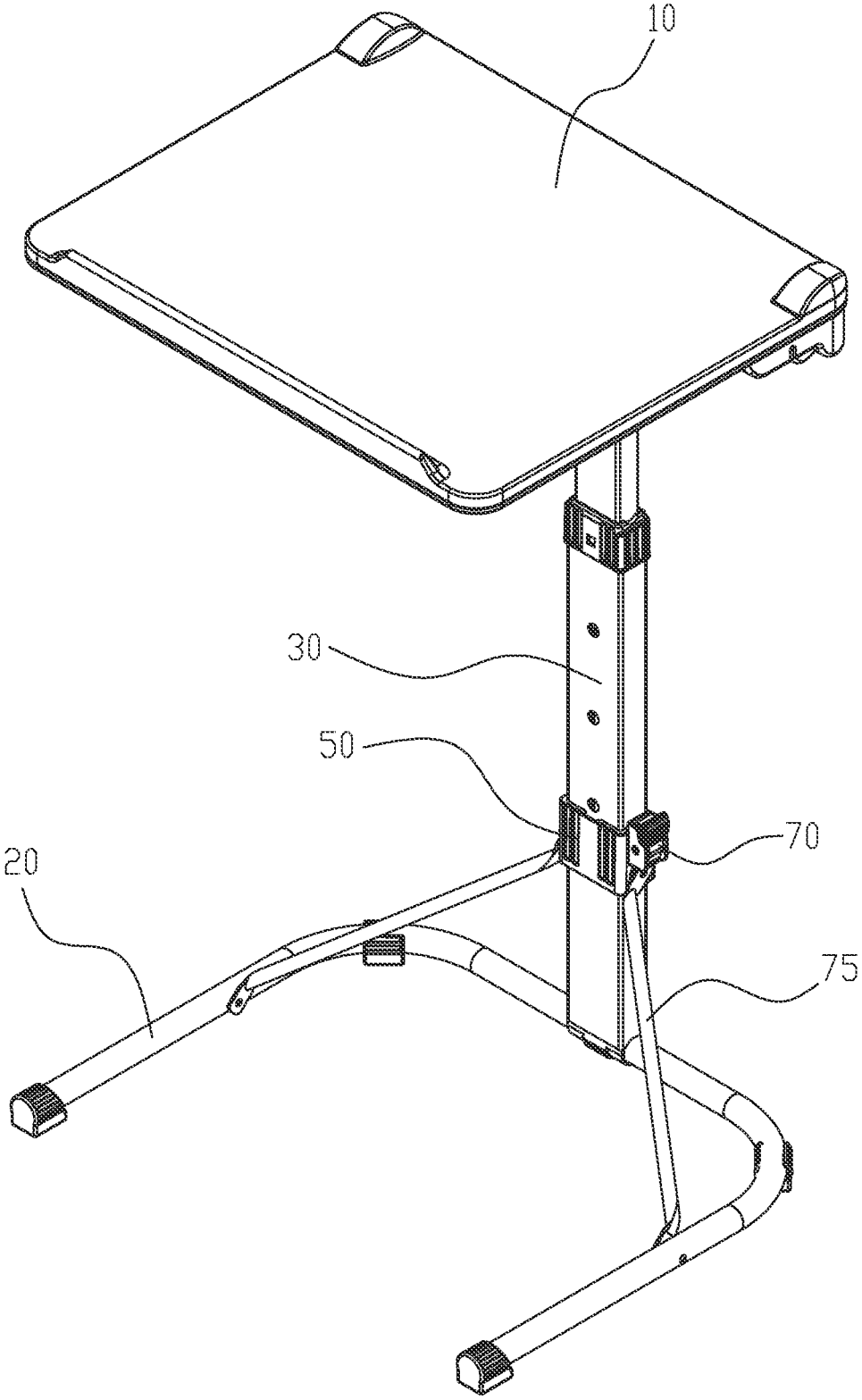
FIG. 10 illustrates a first perspective view of a folding table of Embodiment 2.
Figure 11:
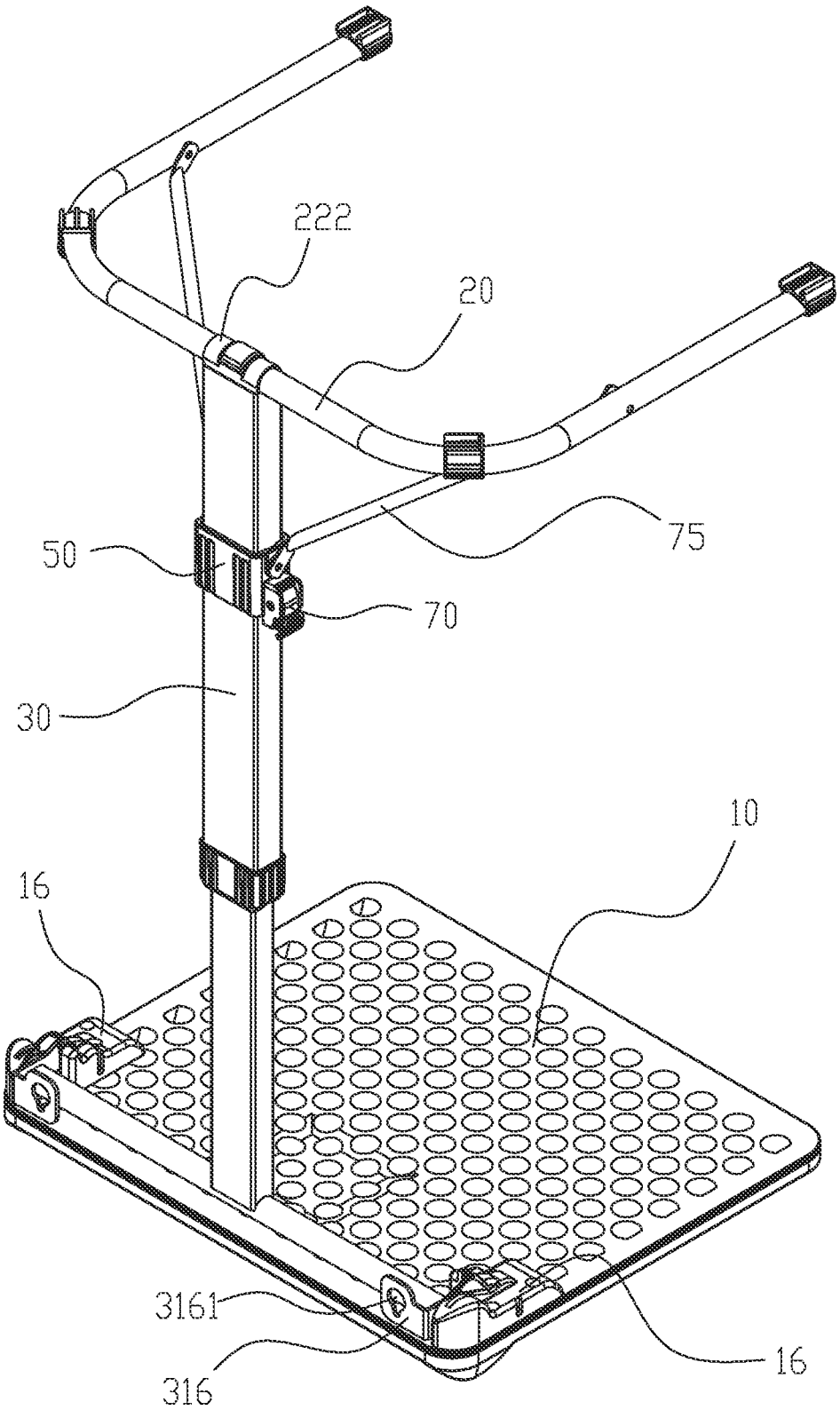
FIG. 11 illustrates a second perspective view of the folding table of Embodiment 2.
Figure 12:
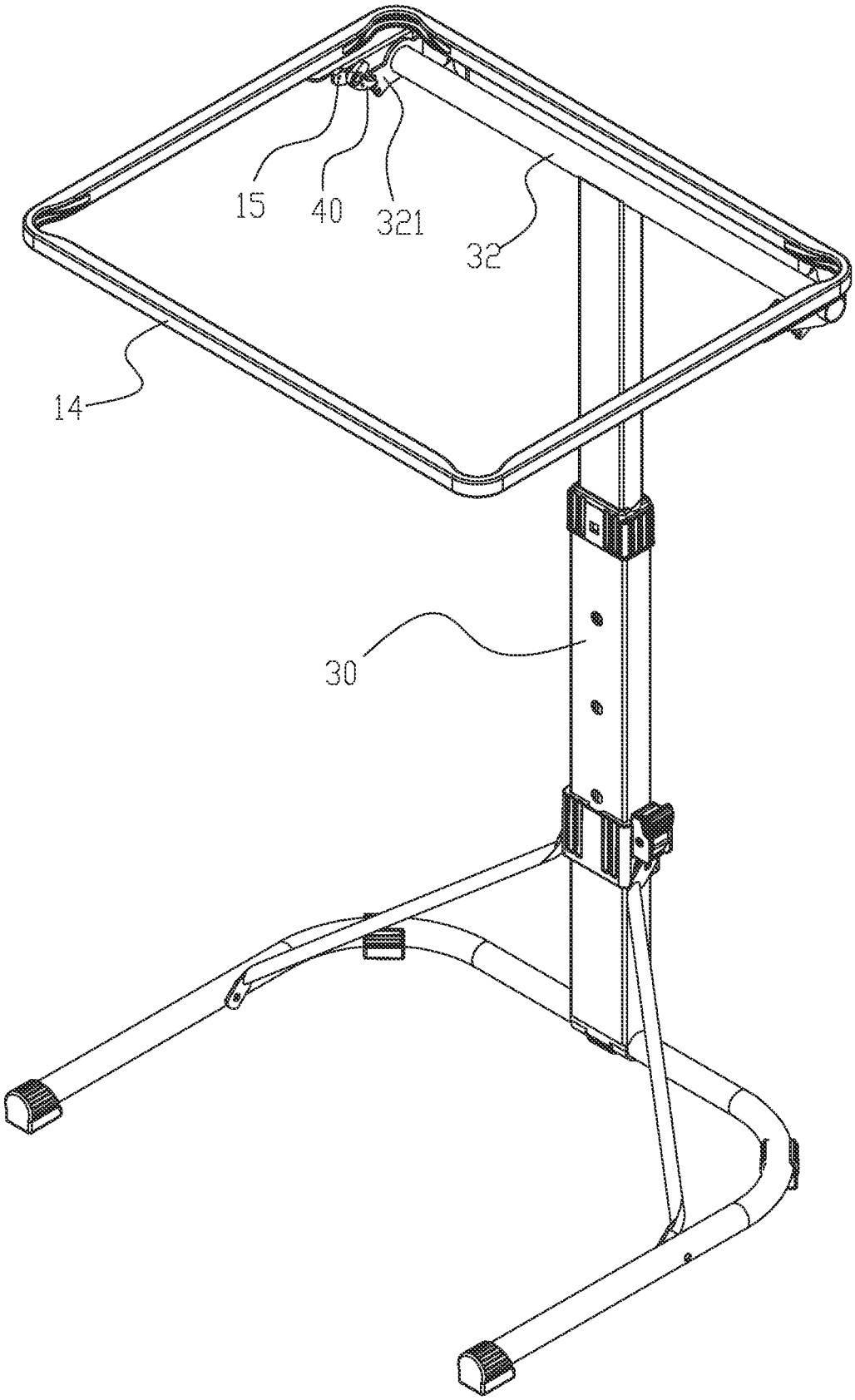
FIG. 12 illustrates a view of the folding table of Embodiment 2 when an upper panel and a lower panel are removed.

In some embodiments, each of the edges of the one or more lock plates 321 comprise a plurality of ratchet wheel grooves 322 disposed along an arc track at intervals. Referring to FIG. 5, the one or more pawls 40 are separated from the plurality of ratchet wheel grooves 322, and the one or more snapping torsion springs 50 are in released states. Referring to FIGS. 6 and 7, when the table board 10 rotates upward, the one or more pawls 40 are disposed in one ratchet wheel groove of the plurality of ratchet wheel grooves 322, and the one or more snapping torsion springs 50 are pressed to sides of the one or more mounting bases 60. Referring to FIGS. 8 and 9, after the one or more pawls 40 slide over one or more uppermost ratchet wheel grooves 322 of the plurality of ratchet wheel grooves 322, the upward elastic forces of the one or more snapping torsion springs 50 are released to drive the one or more pawls 40 to rotate upward, so that arc end surfaces of the one or more pawls 40 face the plurality of ratchet wheel grooves 322 and the one or more pawls 40 are separated from the plurality of ratchet wheel grooves 322. The table board 10 is configured to rotate downward. When the table board 10 rotates downward to be vertically disposed (i.e., rotated downward to the folded state), the one or more pawls 40 are separated from one or more lowermost ratchet wheel grooves 322 of the plurality of ratchet wheel grooves 322. Since the number of ratchet wheel grooves 322 is multiple, when the one or more pawls 40 are engaged with different ratchet wheel grooves 322, an opening angle of the table board 10 is different, so that a work angle of the table board 10 can be adjusted. In some embodiments, the table board 10 is in a horizontal state when the one or more pawls 40 are disposed in the one or more uppermost ratchet wheel grooves 322 (as shown in FIG. 7).

In some embodiments, the folding table further comprises one or more reset torsion springs 80, and the one or more reset torsion springs 80 apply elastic forces to the table board 10 to enable the table board 10 to have a tendency to rotate downward (e.g., to the folded state). After the table board 10 rotates upward (e.g., to the unfolded state), the one or more pawls 40 slide over the uppermost ratchet wheel groove 322

(as shown in FIG. 8), the user releases two hands, and the table board 10 automatically rotates downward to be folded due to the one or more reset torsion springs 80, so that the table board 10 can be automatically folded.

In some embodiments, the one or more mounting bases 60 cover the plurality of ratchet wheel grooves 322, and the one or more reset torsion springs 80 are tensioned between the one or more mounting bases 60 and the one or more lock plates 321.

In some embodiments, one or more reinforcing members 90 are disposed in the one or more mounting bases 60. The one or more reinforcing members 90 encompass the upper crossbar 32, and the one or more pawls 40 are rotatably connected to the one or more reinforcing members 90. The one or more snapping torsion springs 50 are tensioned between the one or more reinforcing members 90 and the one or more pawls 40, and the one or more reset torsion springs 80 are tensioned between the one or more reinforcing members 90 and the upper crossbar 32. The one or more reinforcing members 90 have better strength, and the one or more pawls 40 are connected to the one or more reinforcing members 90 to ensure that positions of the one or more pawls 40 does not move, so that the one or more pawls 40 more accurately mate and are disposed in the plurality of ratchet wheel grooves 322.

In some embodiments, two ends of the upper crossbar 32 are each disposed with a lock plate 321 of the one or more lock plates 321, and the bottom portion of the table board 10 is disposed with two pawls 40 of the one or more pawls 40, so that the structure is more balanced. Two mounting bases 60 of the one or more mounting bases 60 are correspondingly disposed on the lower side of the table board 10, and the two pawls 40 are respectively disposed in the two mounting bases 60. In addition, the two ends of the upper crossbar 32 are respectively pivotally connected to the two mounting bases 60. The two mounting bases 60 are used to cover the two ends of the upper crossbar 32, and the structure is simple.

In some embodiments, rear sides of the one or more lock plates 321 disposed on the upper crossbar 32 comprises hanging holes 100. The folding table can be hung on a hook of a wall using the hanging holes 100.

In some embodiments, the bracket 30 is I-shaped. The bracket 30 comprises a support pole 34 vertically disposed, the upper crossbar 32 connected to an upper end of the support pole 34, and a lower crossbar 36 connected to a lower end of the support pole 34. The support pole 34 can be extended and contracted (i.e., the support pole 34 is telescopic) to facilitate a height adjustment of the table board 10. In addition, the support leg 20 is rotatably connected to the lower crossbar 36, so that the support leg 20 can also be folded. In some embodiments, the folding table further comprises a locking mechanism 703 for locking the support leg 20 to the lower crossbar 36, so that the support leg 20 is more stable when the support leg 20 is unfolded.

In this embodiment, the table board 10 comprises a bottom plate 101, a panel 102, and a reinforcing frame 103 disposed between the bottom plate 101 and the panel 102. The bottom plate 101 and the panel 102 are made by blister technology and have thin thicknesses.

Embodiment 2

Embodiment 2 differs from Embodiment 1 in that: referring to FIGS. 10-14, the table board 10 comprises an upper panel 12, a lower panel 13, an embedded metal frame 14, and two mounting pieces 15. The upper panel 12 covers the lower panel 13 up and down (i.e., in a vertical direction), and the embedded metal frame 14 is disposed between a periphery of the upper panel 12 and a periphery of the lower panel 13. The upper panel 12 and the lower panel 13 are both blister boards, and the two mounting pieces 15 are symmetrically disposed on a left side and a right side of a rear portion of a bottom surface of the lower panel 13. The two mounting pieces 15 are connected to the embedded metal frame 14, and the two ends of the upper crossbar 32 are respectively and pivotally connected to the two mounting pieces 15. Therefore, the bracket 30 is rotatably connected to the two mounting piece 15 connected to the embedded metal frame 14 through the upper crossbar 32, and the structure is firm. The upper panel 12 and the lower panel 13 are made of plastic blister boards, which effectively reduces the cost.

In some embodiments, the one or more pawls 40 are movably disposed on the two mounting pieces 15. The one or more pawls 40 correspond with the one or more lock plates 321 one to one, and the one or more snapping torsion springs 50 also correspond with the one or more lock plates 321 one to one.

In some embodiments, a bottom portion of the table board 10 is further disposed with two covers 16. The two covers 16 respectively covers the two mounting pieces 15, the one or more pawls 40, the one or more snapping torsion springs 50 disposed on the left side and the right side of the upper crossbar 32 (i.e., the two ends of the upper crossbar 32).

In some embodiments, rear ends of the one or more lock plates 321 bend to define hanging pieces 316, and the hanging pieces 316 comprise mounting holes 3161 configured to be hung on a wall. The folding table is configured to hang on the wall by the hanging pieces 316. Therefore, when the folding table is to be stored, the folding table is configured to be hung on the wall. When the folding table is in use, the folding table is configured to be hung on the wall, and then the table board 10 is configured to be unfolded.

Figure 13:
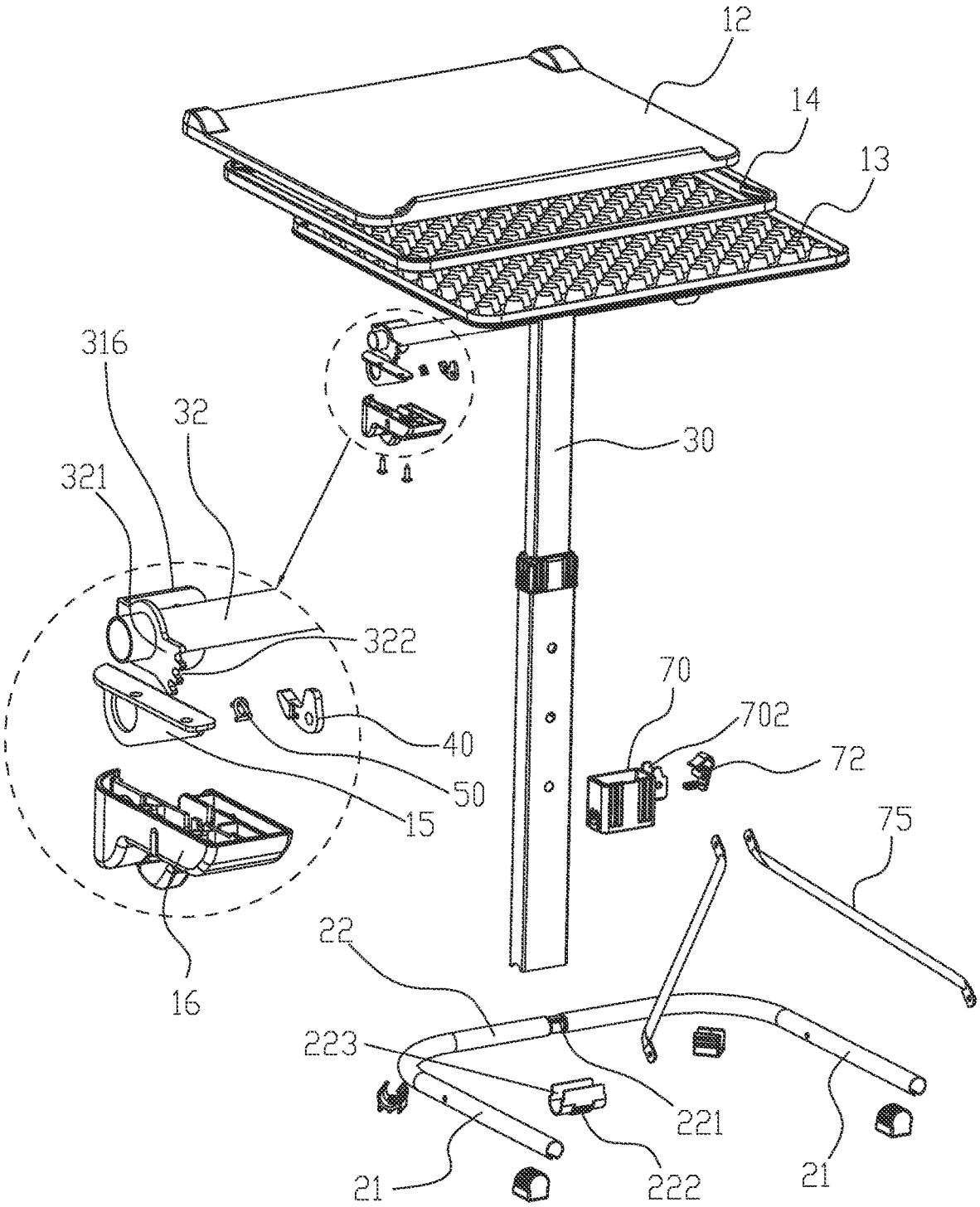
FIG. 13 illustrates an exploded perspective view of the folding table of Embodiment 2.
Figure 14:
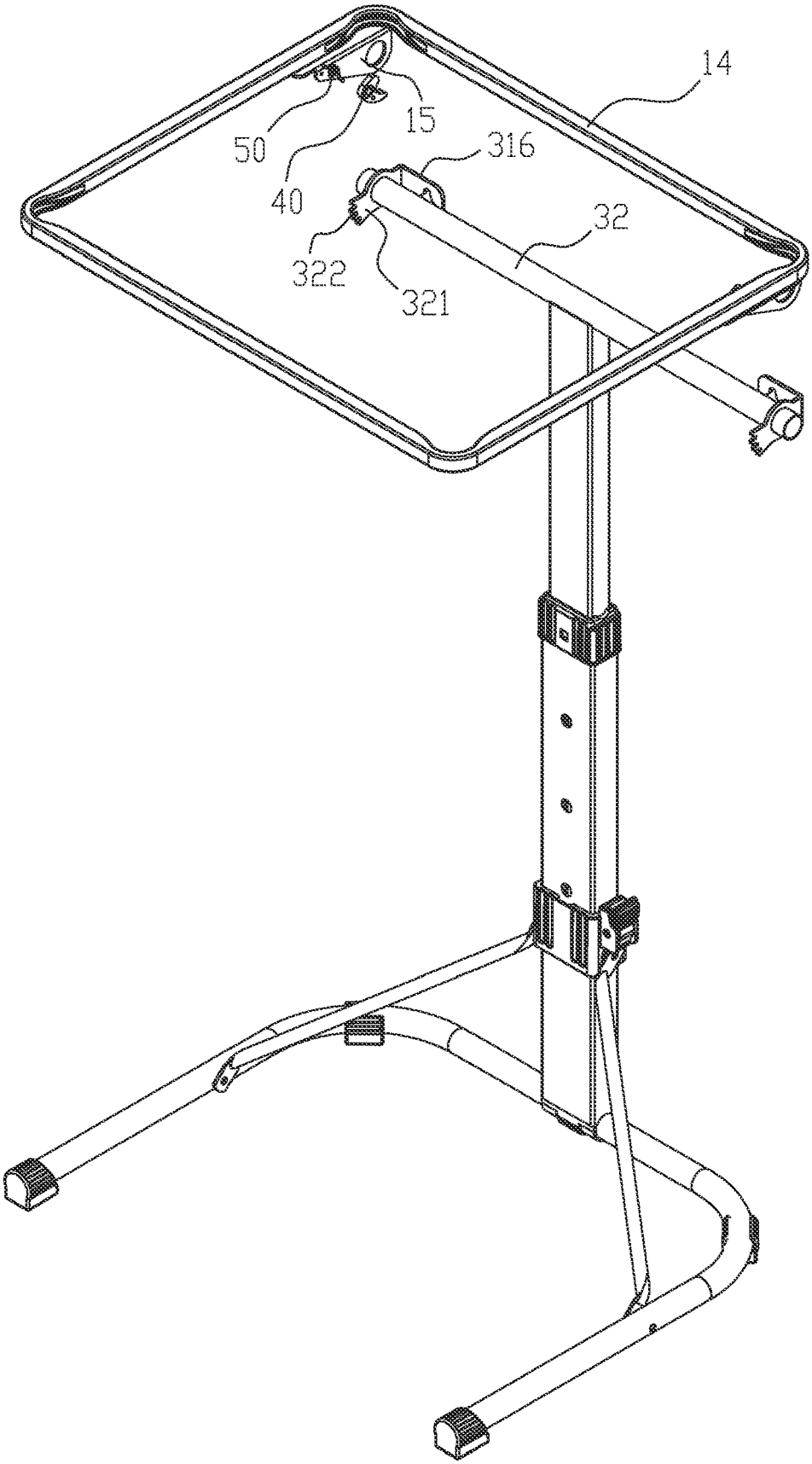
FIG. 14 illustrates an exploded perspective view of the folding table of Embodiment 2 when the upper panel and the lower panel are removed.
Figure 15:
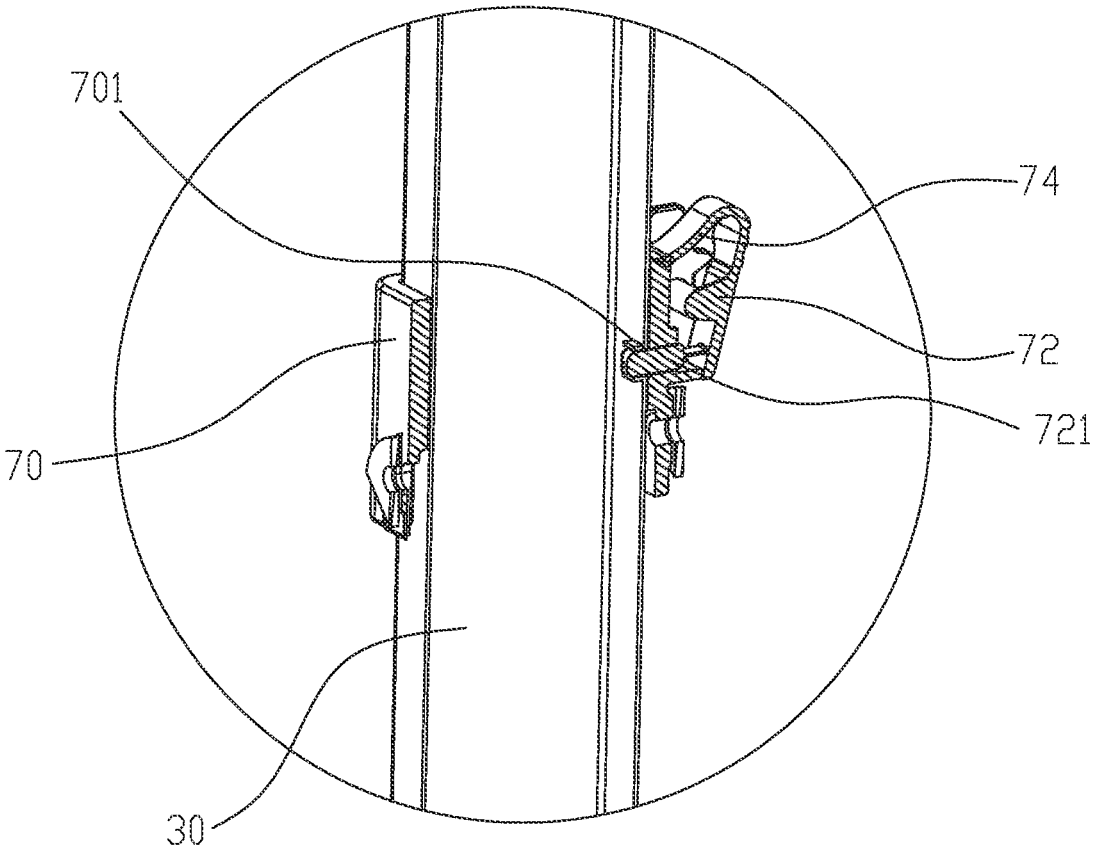
FIG. 15 illustrates a cross-sectional view of a bracket of Embodiment 2 at a position of a sliding sleeve.

In some embodiments, referring to FIG. 13, the support leg 20 defines a U-shaped frame structure with an opening facing forward and comprises two side rods 21 and a connecting rod 22. A middle position of the connecting rod 22 is rotatably connected with a lower end of the bracket 30. The support leg 20 is configured to rotate upward to achieve folding and rotate downward to achieve unfolding.

In some embodiments, the folding table comprises a sliding sleeve 70 vertically and slidably disposed on the bracket 30. Linking rods 75 are respectively disposed between the two side rods 21 and the sliding sleeve 70, and two ends of the linking rods 75 are respectively and rotatably connected between the two side rods 21 and the sliding sleeve 70. The sliding sleeve 70 is disposed with a button 72, and the bracket 30 comprises a locking hole 701. When the support leg 20 is unfolded, the button 72 rightly moves to the locking hole 701 and is disposed in the locking hole 701. Therefore, when the support leg 20 rotates, the linking rods 75 are configured to drive the sliding sleeve 70 to move. When the support leg 20 is unfolded, the button 72 is disposed in the locking hole 701 of the bracket 30 to enable the sliding sleeve 70 to be secured, and the support leg 20 is stably unfolded.

In some embodiments, the button 72 is a single plastic part. A middle portion of the button 72 is pivotally connected to the sliding sleeve 70, a lower portion of the button 72 is disposed with a locking core 721 configured to be disposed in the locking hole 701, and an upper portion of the button 72 defines an elastic arm 74 configured to abut the sliding sleeve 70. An elastic force of the elastic arm 74 enables the locking core 721 to be automatically inserted into the locking hole 701 of the bracket 30. The elastic arm 74 is pressed downward to enable the button 72 to rotate, and the locking core 721 is pulled out. In this embodiment, a side of the sliding sleeve 70 comprises a mounting groove 702 corresponding to the button 72.

In some embodiments, a middle position of the connecting rod 22 is disposed with a rib 221, and a bottom end of the bracket 30 is connected to an end cover 222. The end cover 222 buckles to the connecting rod 22, and the end cover 222 comprises a groove 223 corresponding to the rib 221. In this way, the rib 221 is restricted in the groove 223, the connecting rod 22 cannot move left and right, and the support leg 20 is maintained in the middle position. The groove 223 can further limit an opening angle of the support leg 20. When the support leg 20 is unfolded or folded, the rib 221 is respectively disposed on two ends of the groove 223. The end cover 222 can be buckled on a bottom surface of the bracket 30 or directly welded to the bracket 30.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A folding table, comprising:
a table board,
a support leg,
a bracket connected between the table board and the support leg, and
one or more snapping torsion springs, wherein:
a top portion of the bracket is disposed with an upper crossbar,
the upper crossbar is positioned on a rear portion of a bottom surface of the table board,
the table board is configured to rotate about the upper crossbar,
a bottom portion of the table board is disposed with one or more pawls,
the upper crossbar is disposed with one or more lock plates,
edges of the one or more lock plates comprise at least one ratchet wheel groove,
when the folding table is in a folded state:
the one or more pawls are separated from the at least one ratchet wheel groove, and
the table board rotates downward to be vertically disposed, and
when the folding table is in an unfolded state:
the table board rotates upward,
when the one or more pawls are disposed in the at least one ratchet wheel groove, the one or more snapping torsion springs are compressed to apply upward elastic forces on the one or more pawls to enable the one or more pawls to be fastened to the at least one ratchet wheel groove, so that the table board is locked to prevent the table board from rotating downward, and
when the table board needs to be folded:
the one or more pawls slide over an uppermost ratchet wheel groove of the at least one ratchet wheel groove,
the upward elastic forces of the one or more snapping torsion springs are released to be uncompressed to enable arc end surfaces of the one or more snapping torsion springs to face the at least one ratchet wheel groove to be separated from the at least one ratchet wheel groove,
the one or more snapping torsion springs are maintained to be uncompressed to enable the arc end surfaces to slide over the at least one ratchet wheel groove, and
the table board then rotates downward to be folded.

2. The folding table according to claim 1, wherein:
one or more mounting bases are disposed on the bottom surface of the table board,
the one or more pawls are disposed on the one or more mounting bases,
first ends of the one or more snapping torsion springs are tensioned to abut the one or more mounting bases, and
second ends of the one or more snapping torsion springs are secured to the one or more pawls.

3. The folding table according to claim 1, wherein:
the at least one ratchet wheel groove comprises a plurality of one ratchet wheel grooves, and
the plurality of the ratchet wheel grooves are disposed along an arc at intervals.

4. The folding table according to claim 3, wherein:
when the one or more pawls are disposed in the uppermost ratchet wheel groove, the table board is in a horizontal state.

5. The folding table according to claim 1, comprising:
one or more reset torsion springs, wherein the one or more reset torsion springs apply elastic forces on the table board to enable the table board to rotate downward.

6. The folding table according to claim 5, wherein:
one or more mounting bases are disposed on the bottom surface of the table board,
the one or more pawls are disposed on the one or more mounting bases,
the one or more mounting bases cover the at least one ratchet wheel groove, and
the one or more reset torsion springs are tensioned between the one or more mounting bases and the one or more lock plates.

7. The folding table according to claim 2, wherein:
the one or more mounting bases are disposed with one or more reinforcing members,
the one or more reinforcing members encompass the upper crossbar,
the one or more pawls are rotatably connected to the one or more reinforcing members,
the one or more snapping torsion springs are tensioned between the one or more reinforcing members and the one or more pawls, and
one or more reset torsion springs are tensioned between the one or more reinforcing members and the upper crossbar.

8. The folding table according to claim 6, wherein:
the one or more lock plates comprise at least two lock plates,
two ends of the upper crossbar are each disposed with one of the at least two lock plates,
the one or more pawls comprise two pawls,
the bottom portion of the table board is disposed with the two pawls,
the one or more mounting bases comprise two mounting bases,
the two mounting bases are disposed on the bottom surface of the table board,
the two pawls are respectively disposed in the two mounting bases, the two ends of the upper crossbar are respectively pivotally connected to the two mounting bases, and rear sides of the at least two lock plates disposed on the upper crossbar comprise hanging holes.

9. The folding table according to claim 1, wherein:

the bracket is I-shaped, the bracket comprises a support pole, the upper crossbar connected to an upper end of the support pole, and a lower crossbar connected to a lower end of the support pole, the support pole is telescopic, the support leg is rotatably connected to the lower crossbar, and the support leg is configured to be locked to the lower crossbar using a locking mechanism.

10. The folding table according to claim 1, wherein:

the table board comprises an upper panel, a lower panel, and two mounting pieces, the upper panel covers the lower panel in a vertical direction, an embedded metal frame is disposed between a periphery of the upper panel and a periphery of the lower panel, the upper panel and the lower panel are both blister boards, the two mounting pieces are symmetrically disposed on a left side and a right side of a rear portion of a bottom surface of the lower panel, the two mounting pieces are connected to the embedded metal frame, and two ends of the upper crossbar are respectively and pivotally connected to the two mounting pieces.

11. The folding table according to claim 1, wherein:

two ends of the upper crossbar are respectively provided with the one or more lock plates, rear ends of the one or more lock plates bend to define hanging pieces, and the hanging pieces comprise mounting holes configured to be hung on a wall.

12. The folding table according to claim 1, wherein:

the support leg defines a U-shaped frame structure with an opening facing forward, the support leg comprises two side rods and a connecting rod, a middle position of the connecting rod is rotatably connected to a lower end of the bracket, and the support leg is configured to rotate upward to achieve folding and to rotate downward to achieve unfolding.

13. The folding table according to claim 12, comprising:

a sliding sleeve vertically and slidably disposed on the bracket, and linking rods respectively disposed between the two side rods and the sliding sleeve, wherein:

two ends of the linking rods are respectively and pivotally connected to the two side rods and the sliding sleeve, the sliding sleeve is disposed with a button, the bracket comprises a locking hole, and when the support leg is unfolded, the button rightly moves downward to a position corresponding to the locking hole and is disposed in the locking hole.

14. The folding table according to claim 13, wherein:

the button is a single plastic part, a middle portion of the button is pivotally connected to the sliding sleeve, a lower portion of the button is disposed with a locking core configured to be disposed in the locking hole, and an upper portion of the button defines an elastic arm to abut the sliding sleeve.

15. The folding table according to claim 6, wherein:

the one or more mounting bases are disposed with one or more reinforcing members, the one or more reinforcing members encompass the upper crossbar, the one or more pawls are rotatably connected to the one or more reinforcing members, first ends of the one or more snapping torsion springs are tensioned to abut the one or more reinforcing members, second ends of the one or more snapping torsion springs are secured to the one or more pawls, and one or more reset torsion springs are tensioned between the one or more reinforcing members and the upper crossbar.

* * * * *